US008499772B2

(12) United States Patent
Schumacher

(10) Patent No.: US 8,499,772 B2
(45) Date of Patent: Aug. 6, 2013

(54) VACUUM CLEANER ROLLER NOZZLE

(76) Inventor: Courtney Schumacher, East Rochester, NY (US)

( * ) Notice: Subject to any disclaimer, the term of this patent is extended or adjusted under 35 U.S.C. 154(b) by 376 days.

(21) Appl. No.: 12/948,754

(22) Filed: Nov. 17, 2010

(65) Prior Publication Data

US 2012/0118326 A1 May 17, 2012

(51) Int. Cl.
*B08B 3/00* (2006.01)

(52) U.S. Cl.
USPC ..... 134/60; 134/104.2; 15/300.1; 15/414; 15/415.1; 15/246.2; 15/246.4

(58) Field of Classification Search
None
See application file for complete search history.

(56) References Cited

U.S. PATENT DOCUMENTS

2011/0088195 A1* 4/2011 Dyson et al. ..... 15/300.1

* cited by examiner

*Primary Examiner* — Eric Golightly
(74) *Attorney, Agent, or Firm* — Jaeckle Fleischmann & Mugel LLP

(57) ABSTRACT

The present invention includes a vacuum cleaner nozzle assembly that has protective rollers that glide along the surface to be cleaned without interfering with the function of the vacuum cleaner nozzle. The nozzle comprises a tubular nozzle conduit in fluid communication with a vacuum conduit on a first end of the tubular nozzle and a nozzle mouth at the second end of the tubular nozzle opposite the first end. The nozzle conduit has a circumferential roller assembly collar attached to the outside of the tubular nozzle, the collar is formed with a plurality of radially spaced apart seats that are sized and configured to securely receive a plurality of respective balls that are rotatable inside the respective seats.

9 Claims, 8 Drawing Sheets

VACUUM CLEANER ROLLER NOZZLE

BACKGROUND OF THE INVENTION

1. Field of Invention

This invention relates generally to the art of vacuum cleaner appliances and attachments for vacuum cleaner appliances.

2. Discussion of Related Art

One of the most versatile and depended upon household appliances is the vacuum cleaner. Vacuum cleaners include upright vacuums and canisters. Vacuum cleaners clean by suction created by a blower mechanism. The blower mechanism displaces air in the body of the vacuum causing a vacuum that sucks dirt through a cleaning nozzle. Floor nozzles in both upright vacuums and canister vacuums have wheels, coasters or rollers so that the nozzle does not drag over the floor and thereby scratch, damage or cause unnecessary wear on the floor surface. Since the motion of a floor vacuum cleaner is primarily backwards and forwards, wheels are mounted on the canister or nozzle to allow the vacuum cleaner to move along the floor.

The versatility and utility of the vacuum cleaner has been greatly enhanced by the use of an extension hose, extension wand and various nozzle attachments that are used where the primary vacuum cleaner nozzle is ineffective. Attachments include an unpowered fan head cleaner, an elongated wand with angled tip for cleaning in corners and hard to reach areas, brush nozzles for cleaning delicate fabrics and removing dust and cobwebs. While these nozzles can potentially scratch, tear, wear or otherwise damage walls and other cleaning surfaces when the nozzle is passed over the surface, little has been done to address the problem of scratching.

It is known in the art to have an extension wand and nozzle with a rotatable brush tip. While the brush tip potentially protects surfaces, dirt and fibers (such as string, lint and hair) can get caught in the bristles and inhibit the transfer of dirt into the vacuum nozzle.

It is also known in the art to have wheels on the head of a suction nozzle as a protection. The location of wheels at or near the mouth of the nozzle potentially interferes with the performance of the nozzle. Moreover, the nozzles fitted with wheels are often heavy and unsuitable for convenient cleaning of walls, upholstery or drapes where the nozzles are lifted. Additionally, wheels are effective at moving the nozzle in a forward and backward direction but are primarily unidirectional, and do not provide a full range of motion needed for a hand-held nozzle attachments for cleaning walls, rafters, upholstery or the like.

Accordingly, there exists a need for a vacuum cleaner attachment that reduces the potential for damages to cleaning surfaces caused by contact of the cleaning nozzle over the surface. It is further needed to have a safeguard against damage that works equally effective when the nozzle is moved over the surface in a wide number of directions. It is further needed to have protection that does not interfere with the suction at the mouth of the nozzle. It is likewise advantageous for the device to work effectively with lightweight cleaning nozzles that are hand-held. The present invention addresses one or more of these and other needs.

SUMMARY OF THE INVENTION

The present invention includes a versatile vacuum cleaner attachment that includes protective roller balls that engage the surface to be cleaned. The roller balls glide across the surface and reduce the potential for damages to the surface caused by frictional contact with the cleaning surface. The nozzle works equally effective when the nozzle is moved over the surface in a wide number of directions. The nozzle does not interfere with the suction at the mouth of the nozzle. It is advantageous for the device to work effectively with lightweight cleaning nozzles that are conveniently elevated above the floor during use.

In one embodiment, the vacuum cleaner nozzle comprises a tubular nozzle conduit in fluid communication with a vacuum conduit on a first end of the tubular nozzle and a nozzle mouth at the second end of the tubular nozzle opposite the first end. A circumferential roller assembly collar is attached to the outside of the tubular nozzle. The collar is formed with a plurality of radially spaced apart braces defining therebetween radially spaced apart seats that are sized and configured to securely receive a plurality of respective balls that are rotatable inside the respective seats.

The roller assembly is located proximate to but removed from the nozzle mouth by a distance that is greater than or equal to the diameter of the balls.

The balls, of one embodiment, extend outward from the collar by a distance that is greater than one third of the diameter of the balls but less than one half of the diameter of the balls. Optionally, the balls are rotatably secured into the seat under a pair of respective lips, wherein the distance between the pair of lips is less than the diameter of the balls.

In another embodiment, the collar comprises a first plurality of primary seats for receiving a first plurality of primary balls, and a second plurality of secondary seats mounted to the collar between each said primary seat and sized and configured to receive a plurality of secondary balls.

In still another embodiment, the nozzle mouth is configured to sealably receive an angled corner attachment in fluid communication with the nozzle mouth.

In yet another embodiment, the nozzle mouth is configured to sealably receive a fan shaped cleaner attachment in fluid communication with the nozzle mouth.

The nozzle mouth sealably receives a nozzle attachment having a wedge shaped at one side and a plurality of rounded protrusions at the other side of the felt buffer.

In another embodiment there is a method of cleaning with a vacuum cleaner. The method comprises providing a suction source in fluid communication with a vacuum conduit. A tubular nozzle conduit is provided in fluid communication with the vacuum conduit at a first end of the tubular nozzle and a nozzle mouth at the second end of the tubular nozzle, the tubular nozzle further comprises a circumferential roller assembly collar attached to the outside of the tubular nozzle, the collar is formed with a plurality of radially spaced apart seats that are sized and configured to securely receive a plurality of respective balls that are rotatable inside the respective seats. The surface is vacuumed in with the balls in contact with the surface.

DETAILED DESCRIPTION OF THE INVENTION

Figure 1:
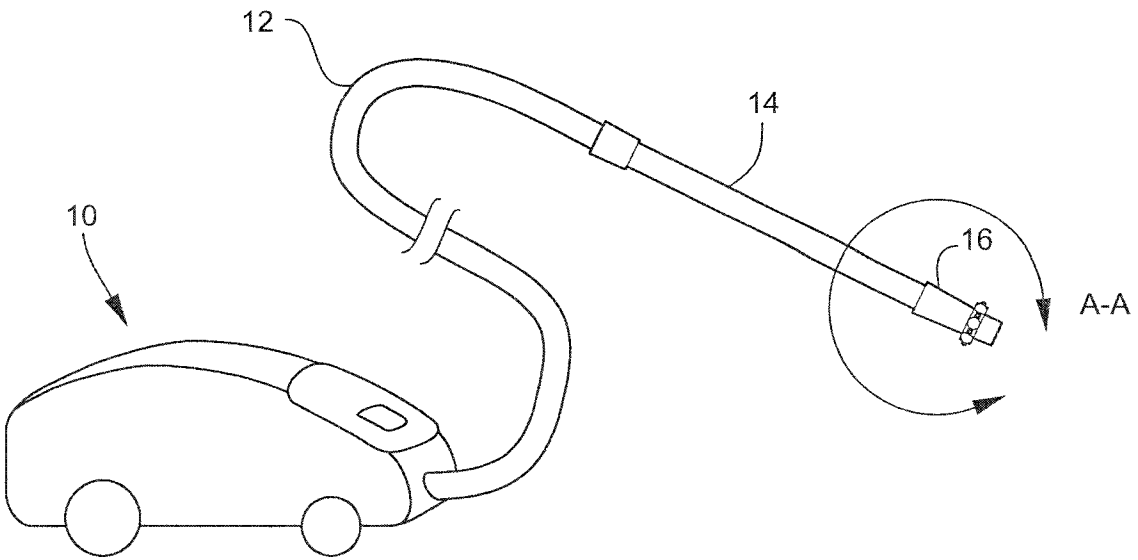
FIG. 1 is a vacuum cleaner with the attachment of one embodiment of the invention.

Reference is made to FIG. 1, illustrating a conventional canister vacuum cleaner 10 with a suction hose 12 connected in fluid communication with the suction source of the vacuum cleaner 10. By fluid communication it is meant that fluid flows from one identified object to or from another identified object either directly or indirectly through one or more conduits, passages or vehicles. A tubular wand 14 is connected to the hose 12 and is likewise in fluid communication with suction source of the vacuum cleaner. The nozzle attachment 16 of one embodiment of the present invention is attached to the tubular wand 14. It is understood that the attachment can be used with any vacuum cleaner type that is known in the art.

Figure 2:
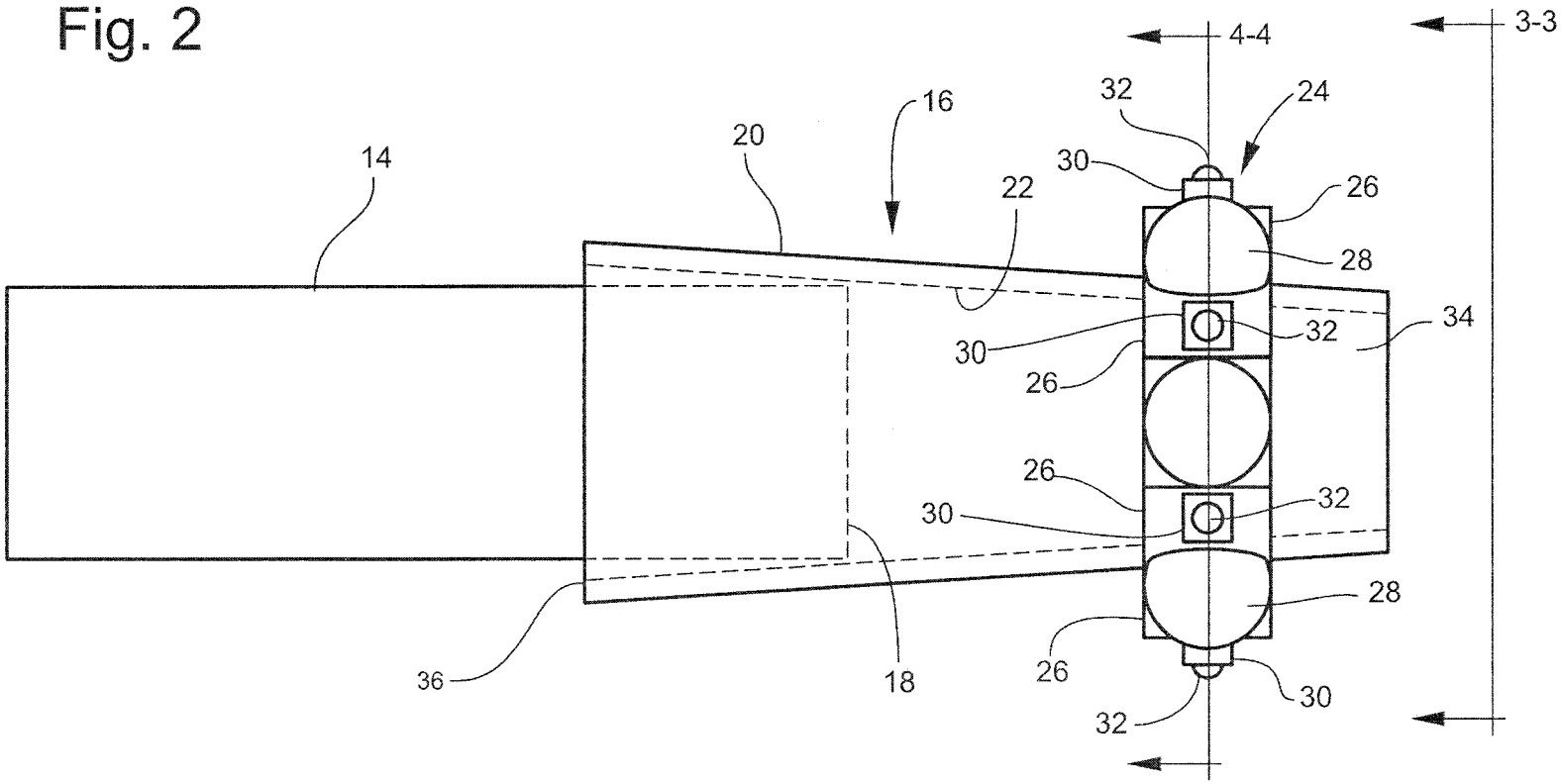
FIG. 2 is an enlarged view of the nozzle attachment of FIG. 1 shown in region A-A.

With reference to FIG. 2, the tubular wand 14 is in fluid communication with the vacuum source in the vacuum cleaner (not shown in FIG. 2). The tubular wand 14 has a wand tip 18 that is inserted telescopically into the first end 36 of the nozzle to sealably connect the tubular wand 14 to the nozzle attachment 16. The nozzle attachment 16 has a tubular body 20 that defines an inner passage 22. In one embodiment, the tubular body 20 is cylindrical. In another embodiment, the tubular body is frusto-conical. In yet another embodiment the first end of the body is generally frusto-conical shape that corresponds to the frusto-conical shape of the first end of the wand 14. The nozzle has a mouth 34 at the second end opposite the first end through which dirt from the cleaning surface is sucked into the vacuum attachment 16. Proximal to but offset from the second end is a roller assembly collar 24. The roller assembly collar 24 is attached to the outer surface of the tubular body 20 or is alternatively integrally molded to the tubular body 20 in a single piece. The offset from the mouth 34 of the tubular body 20 is equal to or greater than the radius of the roller balls 30 to prevent the balls 30 from interfering with the function of the nozzle mouth 34. Additionally, the roller balls are attached to the outer surface of the tubular body 20, so that the passage 22 is unbroken by the roller ball assembly 24 and remains airtight.

Figure 3:
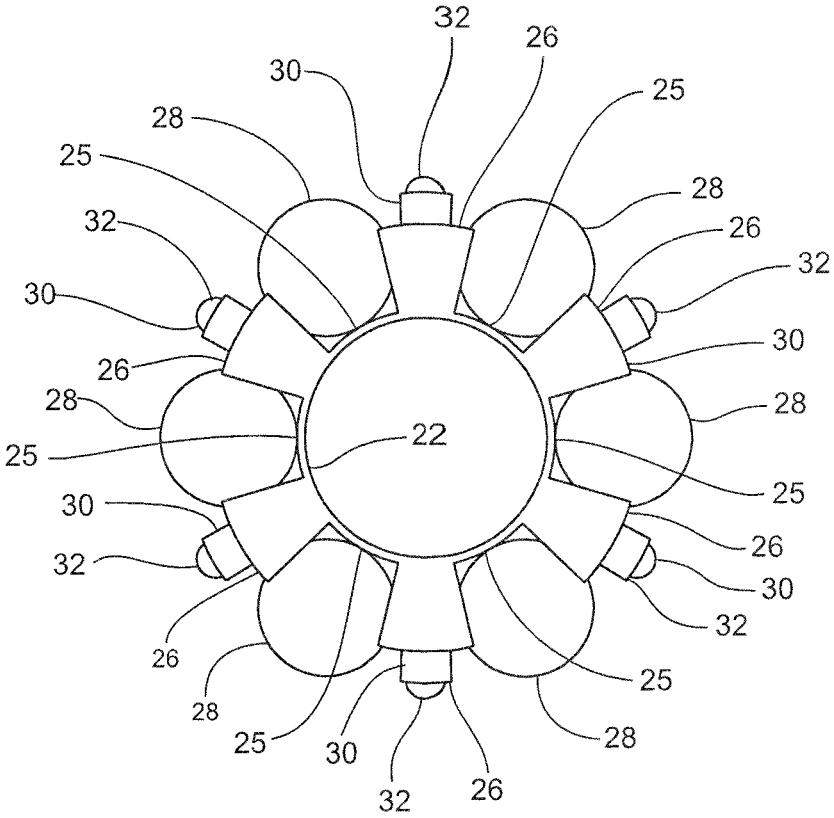
FIG. 3 is an end view of the nozzle attachment of FIG. 2.
Figure 4:
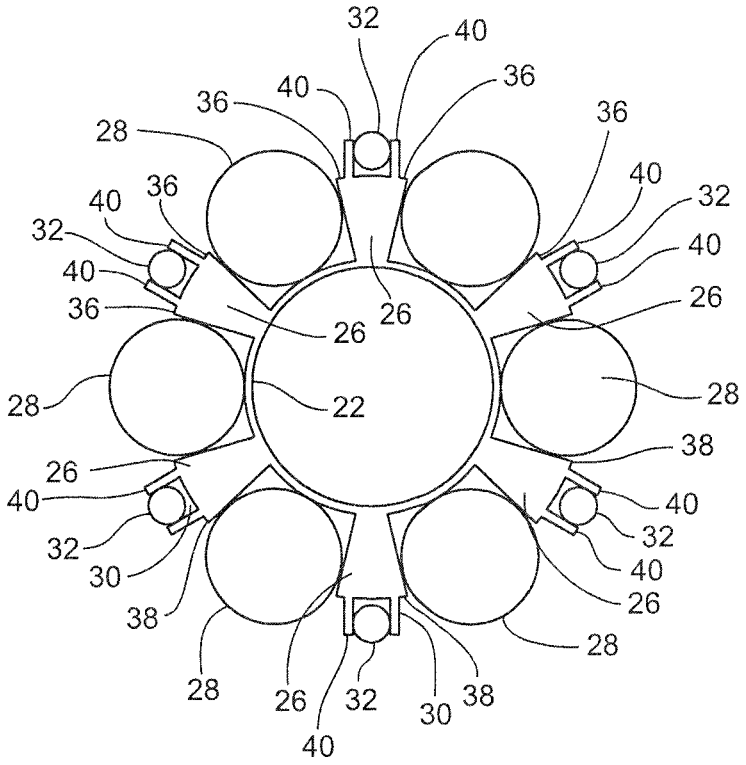
FIG. 4 is a sectional view of the nozzle of FIG. 2 taken along the lines 4-4.

The roller ball assembly 24 can be viewed with reference to FIGS. 3 and 4 with continued reference to FIG. 2. The roller ball assembly includes a plurality of primary seats 25 between radially spaced apart primary braces 26. The primary seats 25 receive the primary balls 28 so that the primary balls 28 are free to rotate within the primary seats that receive a plurality of primary roller balls 28. However, the primary braces 26 have primary lips 36 that hold the primary roller balls 28 securely yet loosely in place. While it is observed that the illustration shows six radially spaced apart primary roller balls 28, it will be appreciated by a person of ordinary skill in the art that the present invention could by made with any plural number of primary roller balls 28. In one embodiment, two to sixteen primary roller balls are optionally used. In another embodiment, two to twelve primary roller balls are used. In another embodiment eight primary roller balls are used. The primary roller balls 28 of FIGS. 2-4 are a minimum of 0.5 cm and a maximum of 2 cm in diameter. Preferably the primary roller balls are about 1 cm. Less than 0.5 cm of a 1 cm roller ball will the balls will extend beyond the braces 26. At least one third of the primary roller balls 28 extend beyond the primary brace 26 and less than half of the primary roller balls 28 extend beyond the primary brace 26.

It will be appreciated that in one embodiment, the primary braces 26 leave a sizable gap between the primary balls 28. Accordingly, secondary braces 30 can be formed to receive secondary roller balls 32 in the seat of the secondary braces 30. As shown in FIG. 4, a cutaway view of the assembly, the secondary balls are rotatably received under secondary lips 40. The secondary balls are secure within the braces but are sufficiently loose so that they can rotate freely. The secondary balls are a minimum of about 0.3 cm and a maximum of about 0.8 cm. Preferably the secondary roller balls 32 are about 0.4 cm. The primary and secondary roller balls conform to the contour of the balls.

Figure 5:
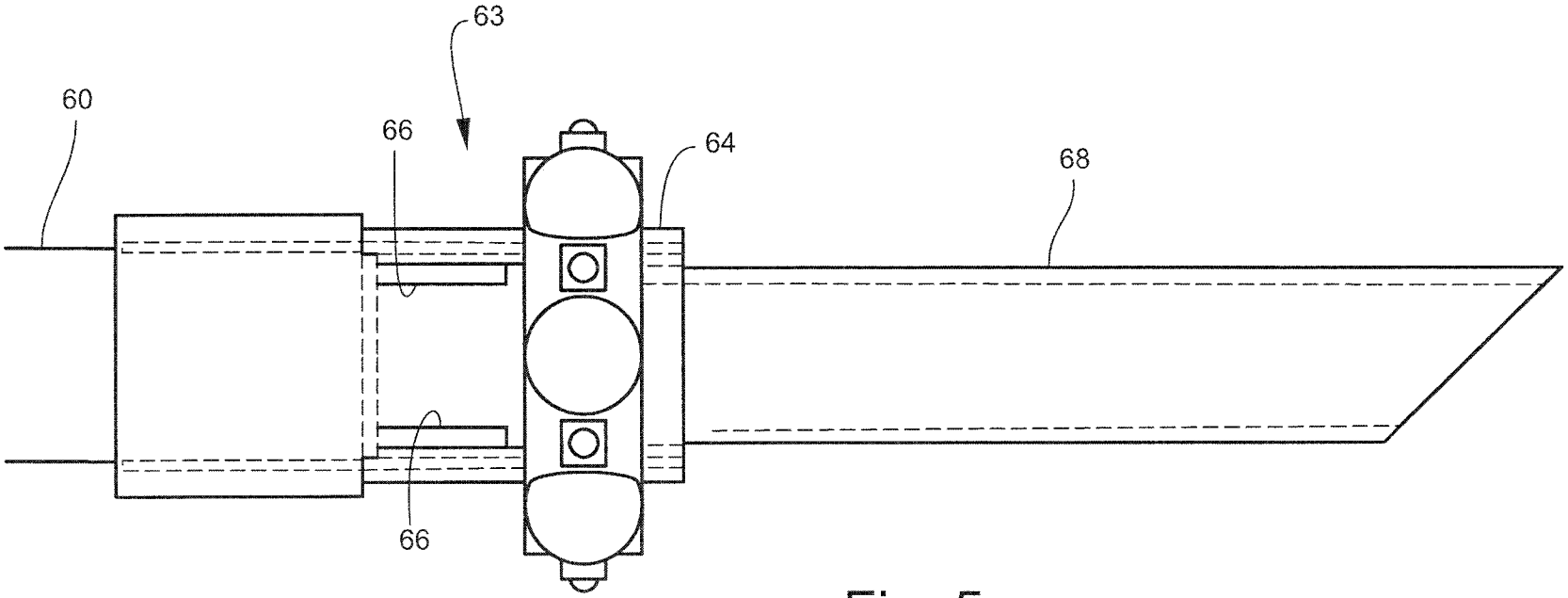
FIG. 5 is a nozzle attachment of one embodiment of the present invention with an angled corner attachment.
Figure 6:
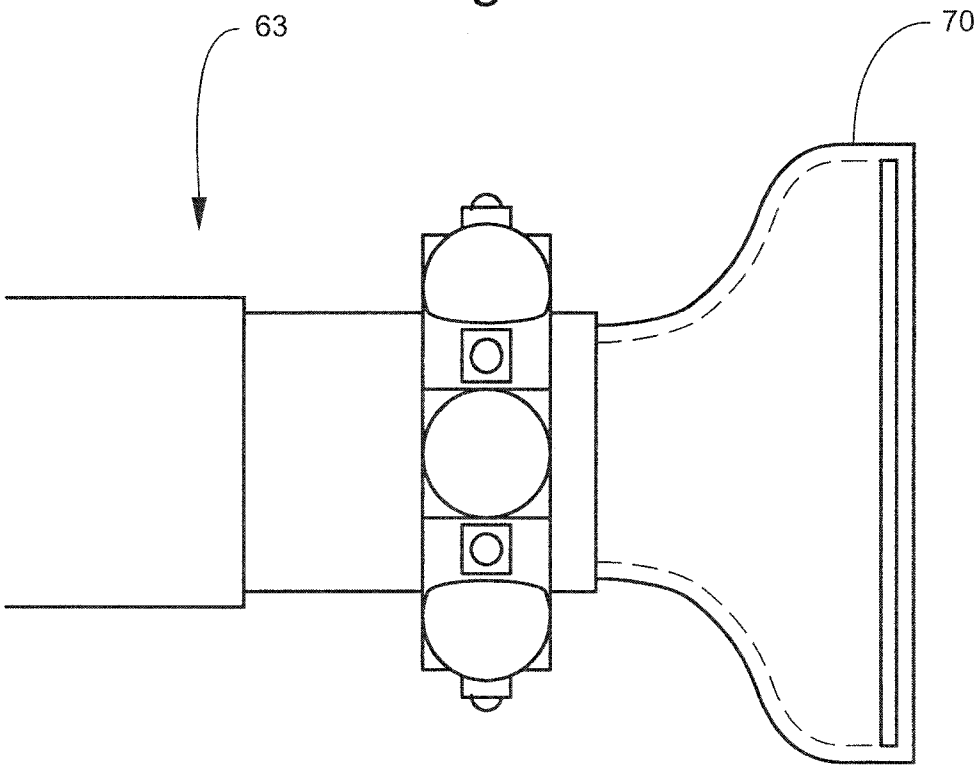
FIG. 6 is a nozzle attachment of one embodiment of the present invention with a fan-shaped nozzle attachment.

With reference to FIGS. 5-8, the roller nozzle 63 is capable of receiving a hose 60 or wand attachment at a first end. The second end of the roller nozzle is configured to receive a standard attachment such as an angled tip corner nozzle attachment 68. The roller nozzle 63 has an inner tubular member 66 and an outer tubular member coaxially spaced apart from the inner tubular member 66 that are separated by a gap of between 0.1 cm and about 0.4 cm, preferably about 0.2 cm. The inner tube 66 is sized and configured to sealably receive a standard attachment such as an angled corner nozzle attachment 68 as shown in FIG. 5, a fan attachment 70 as shown in FIG. 6, and a novel felt buffer attachment 72 of FIG. 7-8 in the gap between the inner tubular member 66 and the outer tubular member 64. The inner tubular member 66 is optionally frusto conical shape and the attachment is telescopically received over the inner tubular member 66.

Figure 8:
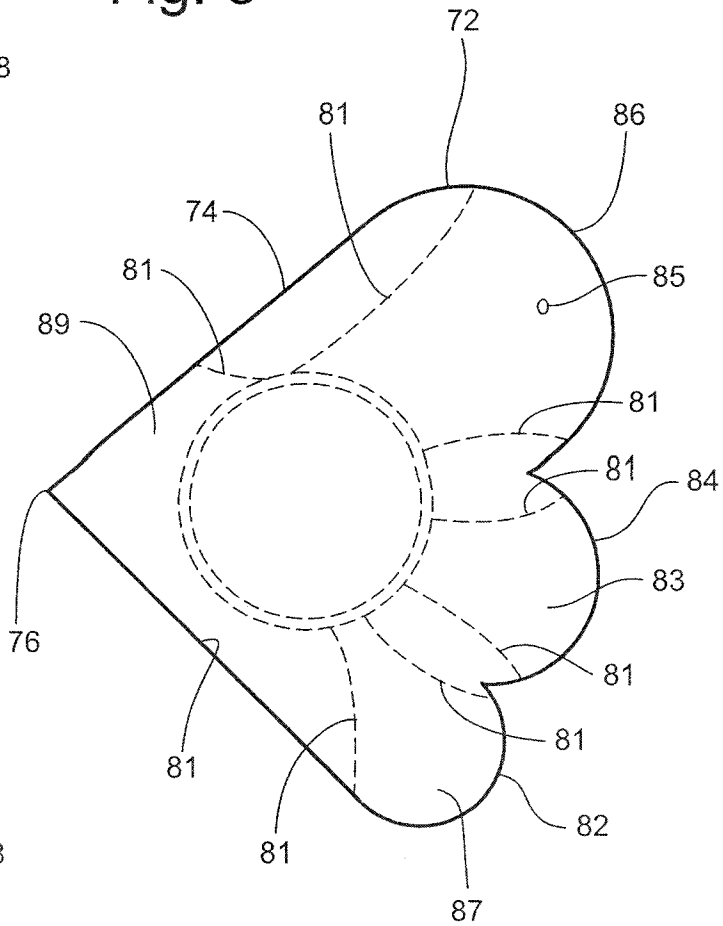
FIG. 8 is an end view of the felt tip buffer of one embodiment of the present invention.
Figure 7:
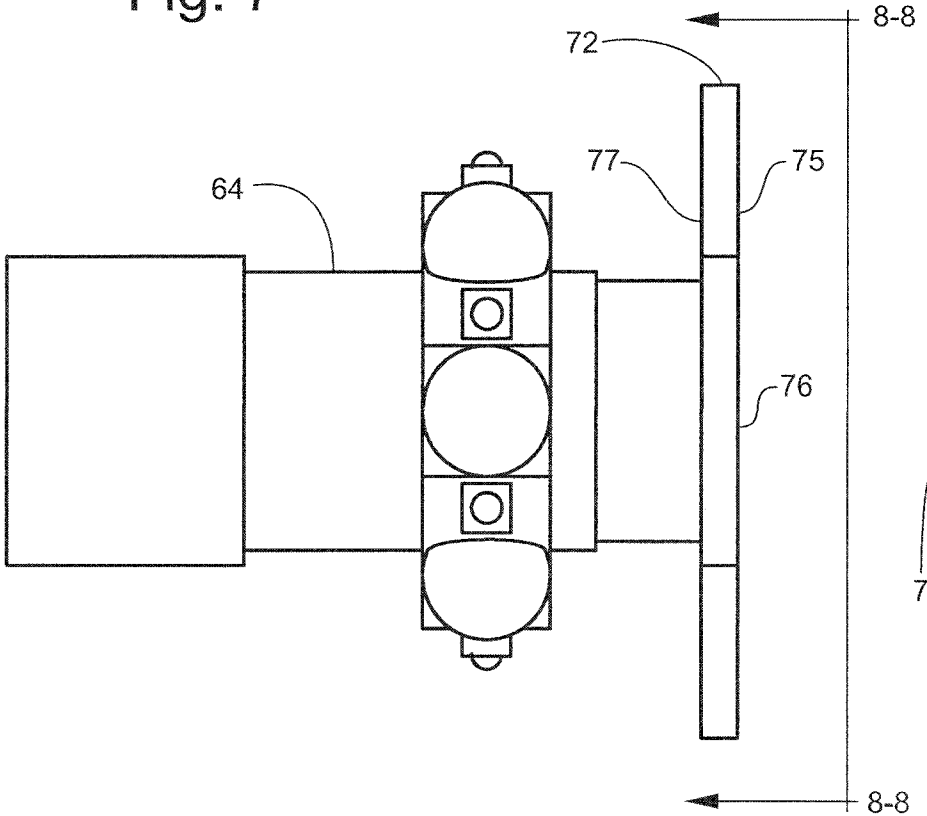
FIG. 7 is a nozzle attachment of one embodiment of the present invention having a felt tip buffer.

With reference to FIGS. 7 and 8, an attachment to the roller nozzle would be an irregularly shaped nozzle 72. The nozzle is generally triangular having a near right angle wedge shape 74 at one side. The wedge shape has a corner tip 76. The opposite side of the wedge shaped nozzle 72 is formed with a plurality of arc shaped circles 82, 84, and 86 of varying radii. The largest circle 86 is about 3 cm. The medium circle 84 is about 2 cm. The smallest circle 82 is about 1.5 cm. The purpose of these arcs and angles is to better fit the area to be vacuumed in a variety of applications. The irregular shaped nozzle 72 is formed by a top plate 75 and a bottom plate 77 forming a gap therebetween. A plurality of fins 81 are placed between the top plate and the bottom plate to form attachment points. And to create multiple air channels 83, 85, 87 and 89. The air channels concentrate the vacuum flow in the desired locations. Felt buffers are optionally located around the perimeter of the nozzle to provide a buffer between the nozzle and the delicate surfaces on which the nozzle may be used to clean.

Figure 9:
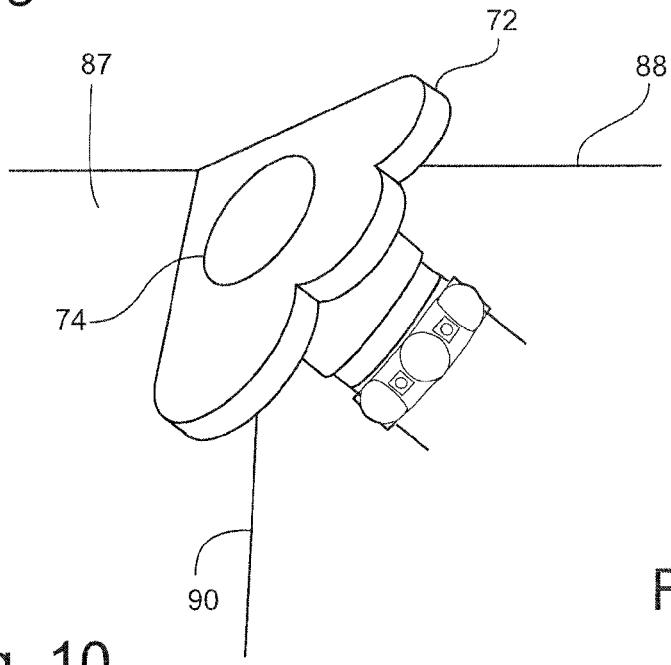
FIG. 9 illustrates the use of the nozzle attachment having a felt-tip buffer for cleaning a wallpaper seam.

As illustrated in FIG. 9, the nozzle 72 can be used to vacuum not only corners but wallpaper surfaces 97 that have horizontal seams 88 and vertical seams 90 that are often sensitive to tearing when a vacuum is passes over the wallpaper 97.

Figure 10:
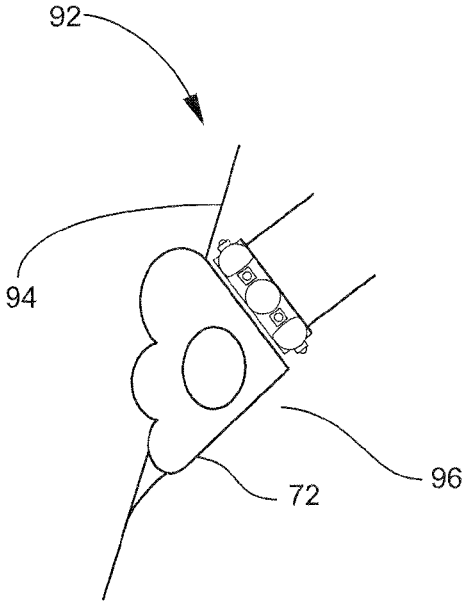
FIG. 10 illustrates the use of the nozzle attachment with a felt-tip buffer for cleaning a sofa seam.

As illustrated in FIG. 10, the nozzle 72 can clean the sofa seam 92 between, for example the sofa back 94 and sofa seat 96. The small circular attachment fits into the seam 92.

Figure 11:
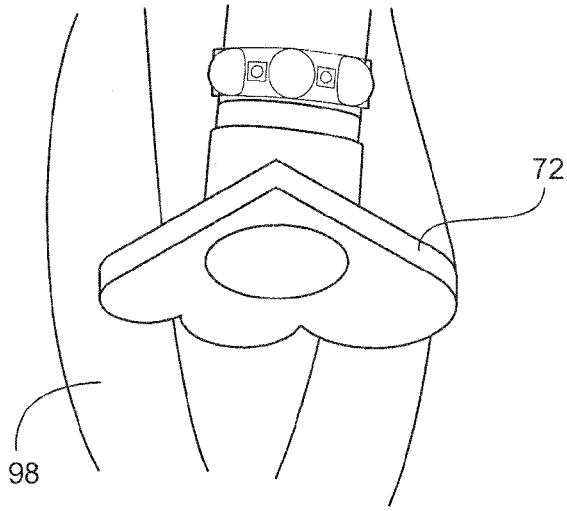
FIG. 11 illustrates the use of the nozzle attachment with a felt-tip buffer for cleaning drapery.

As illustrated in FIG. 11, the nozzle 72 can be used to effectively clean a drapery 98. The plurality of circular arcs 80 gently brush against the pleats of the drapery 98.

What is claimed is:

1. A vacuum cleaner nozzle comprising:

a tubular nozzle conduit in fluid communication with a vacuum conduit on a first end of the tubular nozzle and a nozzle mouth at a second end of the tubular nozzle opposite the first end; and a circumferential roller assembly collar attached to the outside of the tubular nozzle, wherein the collar is formed with a plurality of radially spaced apart seats that are sized and configured to securely receive a plurality of respective balls that are rotatable inside the respective seats.

2. The nozzle of claim 1, wherein the roller assembly is located proximate to but removed from the nozzle mouth by a distance that is greater than or equal to a diameter of the balls.

3. The nozzle of claim 1, wherein the balls extend outward from the collar by a distance that is greater than one third of a diameter of the balls but less than one half of the diameter of the balls.

4. The nozzle of claim 1, wherein the balls are rotatably secured into the seat under a pair of respective lips, wherein the distance between the pair of lips is less than a diameter of the balls.

5. The nozzle of claim 1, wherein the collar comprises a first plurality of primary seats for receiving a first plurality of primary balls, and a second plurality of secondary seats mounted to the collar between each said primary seat and sized and configured to receive a plurality of secondary balls, and wherein the secondary balls are smaller than the primary balls.

6. The nozzle of claim 1, wherein the nozzle mouth is configured to sealably receive an angled corner attachment in fluid communication with the nozzle mouth.

7. The nozzle of claim 1, wherein the nozzle mouth is configured to sealably receive a fan shaped cleaner attachment in fluid communication with the nozzle mouth.

8. The nozzle of claim 1, wherein the nozzle mouth sealably receives a multiple-use attachment having a wedge shaped at one side and a plurality of rounded protrusions at another side of the attachment.

9. The nozzle of claim 1, wherein the tubular nozzle comprises an outer tube and an inner tube radially spaced from the outer tube by a distance that is a minimum of 0.1 cm and a maximum of about 0.3 cm, and wherein an additional nozzle is received between the inner tube and outer tube.

* * * * *